US011166538B2

(12) United States Patent
Fenton

(10) Patent No.: US 11,166,538 B2
(45) Date of Patent: Nov. 9, 2021

(54) ANTI-SPREADER HAMMOCK STAND

(71) Applicant: Calvin Fenton, Casper, WY (US)

(72) Inventor: Calvin Fenton, Casper, WY (US)

( * ) Notice: Subject to any disclaimer, the term of this patent is extended or adjusted under 35 U.S.C. 154(b) by 0 days.

(21) Appl. No.: 16/779,614

(22) Filed: Feb. 2, 2020

(65) Prior Publication Data

US 2021/0235852 A1 Aug. 5, 2021

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A45F 3/44; A45F 4/08; A47C 17/84; E04H 15/04
See application file for complete search history.

(56) References Cited

U.S. PATENT DOCUMENTS 10,441,060 B1 * 10/2019 Pinholster, Jr. ..... A47C 9/105
2002/0166171 A1 * 11/2002 Ke ..... A45F 3/24 5/121
2004/0206861 A1 * 10/2004 Le Gette ..... A45F 3/24 248/166
2005/0246836 A1 * 11/2005 Wu ..... A45F 3/24 5/120
2007/0079442 A1 * 4/2007 Stoll ..... A45F 3/24 5/120
2007/0113337 A1 * 5/2007 Hug ..... A45F 3/22 5/120
2010/0287700 A1 * 11/2010 Reeb ..... A45F 3/22 5/127
2014/0121063 A1 * 5/2014 Wireman ..... A63B 71/023 482/23
2016/0106200 A1 * 4/2016 Brinkley ..... A45F 3/24 5/129
2017/0202344 A1 * 7/2017 Ressler ..... A45F 3/22
2018/0070708 A1 * 3/2018 Ketcher ..... A45F 3/24
2018/0116379 A1 * 5/2018 Fenton ..... A45F 3/24
2018/0228272 A1 * 8/2018 Locher ..... E04H 15/04
2019/0000220 A1 * 1/2019 Lemmens ..... A45F 3/24
2019/0048613 A1 * 2/2019 Bierwolf ..... E04H 15/40
2019/0328116 A1 * 10/2019 Kitzberger ..... A45F 3/24
2020/0046107 A1 * 2/2020 Sabbagh ..... A45F 3/22

* cited by examiner

*Primary Examiner* — Nicholas F Polito
*Assistant Examiner* — George Sun
(74) *Attorney, Agent, or Firm* — Peter Timbers

(57) ABSTRACT

A hammock stand providing ridge poles and anti-spreaders and ridge-base lines to maintain the hammock stand stability and functionality.

10 Claims, 5 Drawing Sheets

ANTI-SPREADER HAMMOCK STAND

FIELD OF THE INVENTION

The present invention relates to a hammock stand having an at least on anti-spreader and therefore able to hold significant weight.

BACKGROUND OF THE INVENTION

Hammock stands are notoriously flimsy and unable to handle significant weight. This is particularly true in regions and areas where trees and other vertical structures are unavailable for use as hammocks. Traditional hammock stands therefore are reliant upon less-than-sturdy vertical structures to support significant weight in the hammock. There is a long-felt need for hammock stand that can support and accommodate significant weight, particularly in areas and regions where vertical structures are not available for hammock use.

SUMMARY OF THE INVENTION

Accordingly, it is an object of embodiments of the present invention to provide for an anti-spreader hammock stand. Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims. To achieve the foregoing and other objects, and in accordance with the purposes of the present invention, as embodied and broadly described herein, the invention comprises a anti-spreader hammock stand comprising a first ridge pole, a second ridge pole, a first anti-spreader, a first base pole, a second base pole, a third base pole, a fourth base pole, a first base ridge junction and a second base ridge junction; said first ridge pole having a first ridge pole proximal end, a first ridge pole distal end, and a first ridge pole intermediate portion between the first ridge pole proximal end and the first ridge distal end, said second ridge pole having a second ridge pole proximal end, a second ridge pole distal end and a second ridge pole intermediate portion between the second ridge proximal end and the second ridge pole distal end; said first base pole having a first base pole top portion and a first base pole bottom portion, said second base pole having a second base pole top portion and a second base pole bottom portion, said third base pole having a third base pole top portion and a third base pole bottom portion said forth base pole having a forth base pole top portion and a forth base pole bottom portion; said first anti-spreader having a first anti-spreader first end and a first anti-spreader second end, said first anti-spreader first end connected to said first ridge pole and said first anti-spreader second end connected to said second ridge pole; said first base ridge junction connected to said first ridge pole proximal end, said second ridge pole proximal end, said first base pole top portion and said second base pole top portion, said second base ridge junction connected to said first ridge pole distal end, said second ridge pole distal end, said third base pole top portion and said forth base pole top portion.

Benefits and advantages of the present invention include, but are not limited to providing portable anti-spreading hammock stand that can support and hold significant weight and which is particularly useful in areas and regions where vertical structures are not readily available for use as hammock vertical supports.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION AND DRAWINGS

Figure 1:
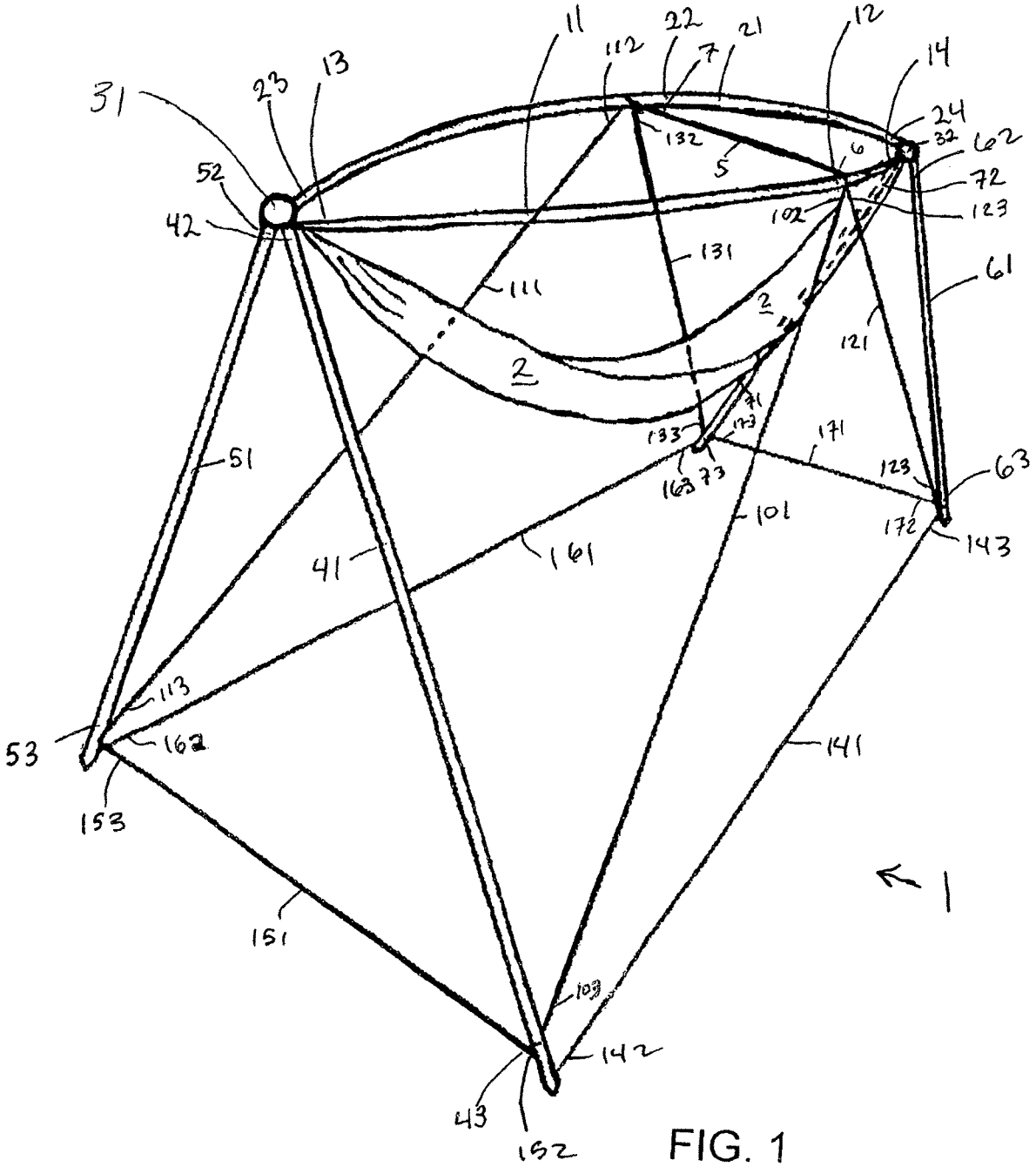
FIG. 1 illustrates a right-side perspective view of one embodiment of the hammock stand.

Reference will now be made in detail to embodiments of the invention, examples of which are illustrated in the accompanying drawings. Throughout the following detailed description, the same reference characters refer to the same or similar elements in all figures. In this detailed description, reference is to a few embodiments of the instant invention, as illustrated in the accompanying and above-referenced drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

FIG. 1 depicts one embodiment of the instant invention comprising an anti-spreader stabilized hammock stand 1, a first ridge pole 11, a second ridge pole 21, an anti-spreader 5, a first base pole 41, a second base pole 51, a third base pole 61, a fourth base pole 71, a first base ridge line 101, a second base ridge line 111, a third base ridge line 121, a fourth base ridge line 131, a first base ridge junction 31, a second base ridge junction 32, a first base pole line 141, second base pole line 151, a third base-pole line 161 and a fourth base pole line 171.

The first ridge pole 11 has a first ridge pole proximal end 13, a first ridge pole distal end 14 and a first ridge pole intermediate portion 12 between the first ridge pole proximal end and the first ridge pole distal. The second ridge pole 21 has a second ridge pole proximal end 23, a second ridge pole distal end 24 and a second ridge pole intermediate portion 22 between the second ridge pole proximal end and the second ridge pole distal.

FIG. 1 also depicts the first base pole 41 having a first base pole top portion 42 and a first base pole bottom portion 43, the second base pole 51 having a second base pole top portion 52 and a second base pole bottom portion 53, the third base pole 61 having a third base pole top portion 62 and a third base pole bottom portion 63 and the forth base pole 71 having a forth base pole top portion 72 and a forth base pole bottom portion 73.

FIG. 1 depicts the first base ridge line 101 having a first base ridge line upper end 102 connected to the first ridge pole 11 at the location of the first ridge pole intermediate region 12 and a first base ridge line lower end 103 connected to the first base pole bottom portion 43.

FIG. 1 depicts the second base ridge line 111 having a second base ridge line upper end 112 connected to the second ridge pole 21 at the location of the second ridge pole intermediate region 22 and a first base ridge line lower end 113 connected to the first base pole bottom portion 53.

FIG. 1 depicts the third base ridge line 121 having a third base ridge line upper end 122 connected to the first ridge pole 11 at the location of the first ridge pole intermediate region 12 and a third base ridge line lower end 123 connected to the third base pole bottom portion 63.

FIG. 1 depicts the fourth base ridge line 131 having a fourth base ridge line upper end 132 connected to the second ridge pole 21 at the location of the second ridge pole intermediate region 22 and a fourth base ridge line lower end 133 connected to the first base pole bottom portion 73.

FIG. 1 also depicts the first base pole line 141 having a proximal first base pole line end 142 connected to the first base pole bottom portion 43 and a distal first base pole line end 143 connected to the third base pole bottom portion 63.

FIG. 1 depicts the second base pole line 151 having a proximal second base pole line end 152 connected to the first base pole bottom portion 43 and a distal second base-pole line end 153 connected to the second base pole bottom portion 53.

FIG. 1 also depicts the third base-pole line 161 having a proximal third base pole-line end 162 connected to the second base pole bottom portion 53 and a distal third base pole-line end 163 connected to the fourth base pole bottom portion 73.

FIG. 1 depicts the fourth base pole line 171 having a distal fourth base-pole line end 173 connected to the fourth base pole bottom portion 73 and a proximal fourth base-pole line end 172 connected to the third base pole bottom portion 63.

FIG. 1 depicts the first base ridge junction 31 connected to the first ridge pole proximal end 13, the second ridge pole proximal end 23, the first base pole top portion 42 and the second base pole top portion 52. FIG. 1 also depicts the second base ridge junction 32 connected to said first ridge pole distal end 14, said second ridge pole distal end 24, said third base pole top portion 62 and said forth base pole top portion 72.

FIG. 1 further depicts a first anti-spreader 5 having a first anti-spreader first end 6 attached to the first ridge pole intermediate region 12 of the first ridge pole 11. The first anti-spreader 5 has a first anti-spreader second end 7 attached to the second ridge pole intermediate region 22 of the second ridge pole 21.

FIG. 1 further depicts a hammock 2 attached to the first base ridge junction 31 and the hammock 2 also attached to the second base ridge junction 32.

Figure 2:
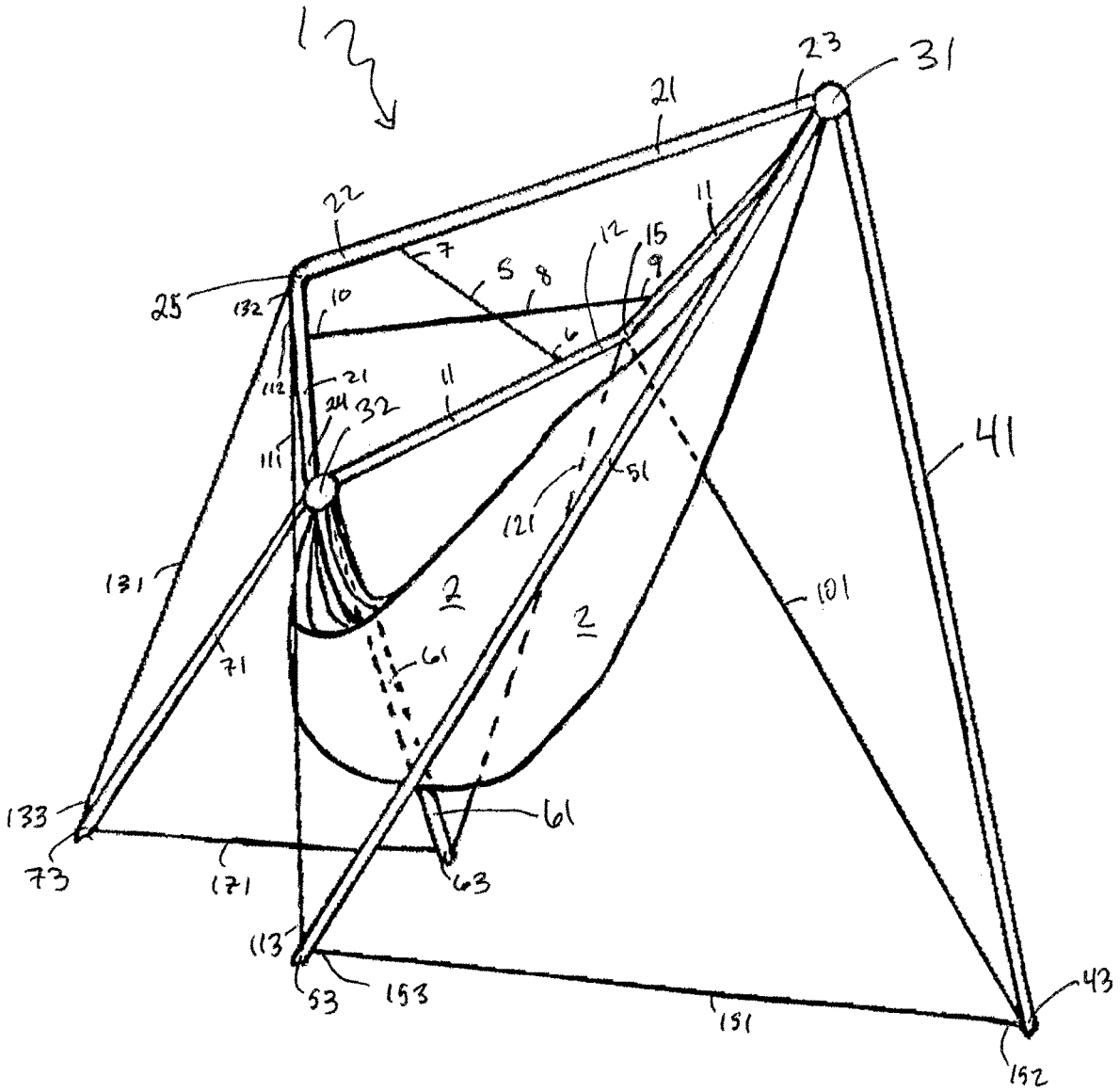
FIG. 2 illustrates a left-side perspective view of one embodiment of the hammock stand.

FIG. 2 depicts another embodiment of the instant invention wherein the first ridge pole 11 has a first ridge pole intermediate junction 15 disposed in the first ridge pole intermediate portion 12 and the second ridge pole 21 has a second ridge pole intermediate junction 25 disposed in the second ridge pole intermediate portion 22.

In FIG. 2, the first anti-spreader 5 having the first anti-spreader first end 6 attached to the first ridge pole intermediate region 12 of the first ridge pole 11. The first anti-spreader 5 has a first anti-spreader second end 7 attached to the second ridge pole intermediate region 22 of the second ridge pole 21. Also depicted is a second anti-spreader 8 having the second anti-spreader first end 9 attached to the first ridge pole intermediate region 12 of the first ridge pole 11. The second anti-spreader 8 has a second anti-spreader second end 10 attached to the second ridge pole intermediate region 22 of the second ridge pole 21.

Figure 3:
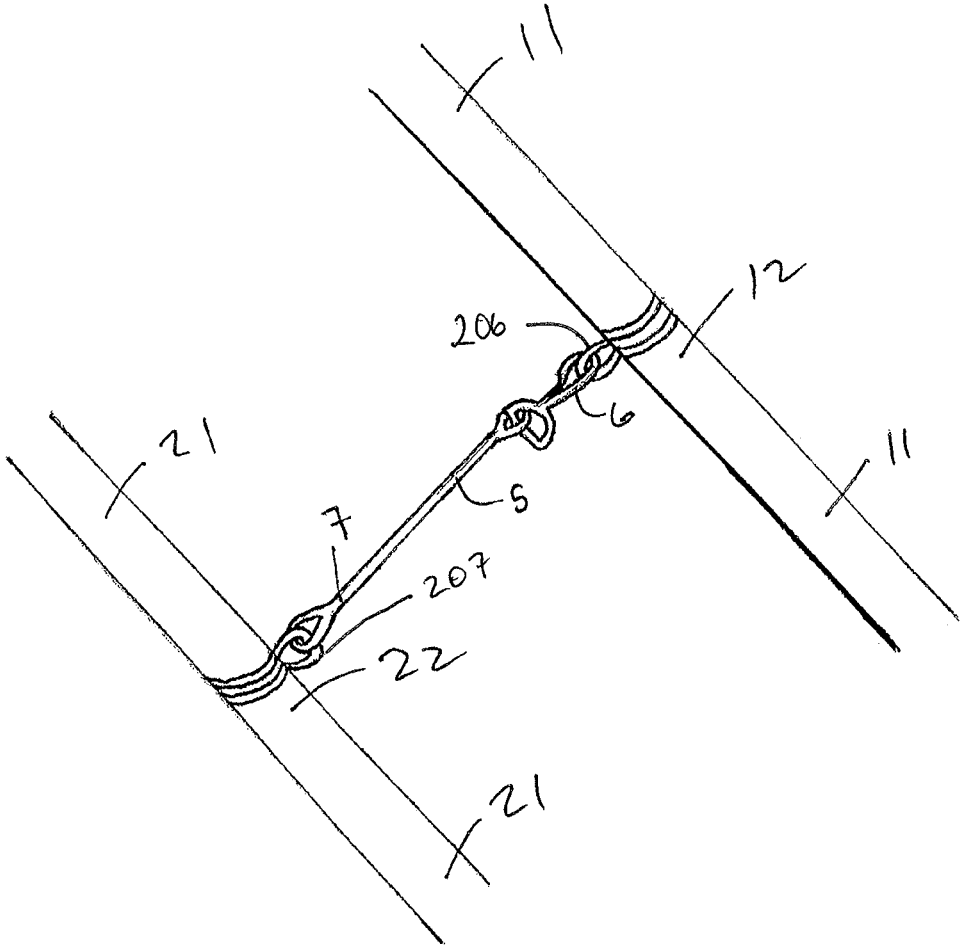
FIG. 3 illustrates a bottom to top view one embodiment of the instant invention depicting two ridge poles and an anti-spreader.

FIG. 1, a side view from the right-side, and FIG. 2, a side view from the left side, are essentially the same, with the exception being the two intermediate junctions and two anti-spreaders. And, although not depicted in FIG. 2, it is fully anticipated that the first base-pole line 141 connecting the first base pole 41 to the third base pole 61 and the third base pole line 161 connecting the second base pole 51 to the fourth base pole 71 are present in many of the embodiments of the instant invention, FIG. 3 depicts one embodiment the first anti-spreader 5 having the first anti-spreader first end 6 attached to a first ridge pole loop 206 and attached to the first ridge pole intermediate region 12 of the first ridge pole 11. The first anti-spreader 5 has a first anti-spreader second end 7 attached to a second ridge pole loop 207 and attached to the second ridge pole intermediate region 22 of the second ridge pole 21.

Figure 4:
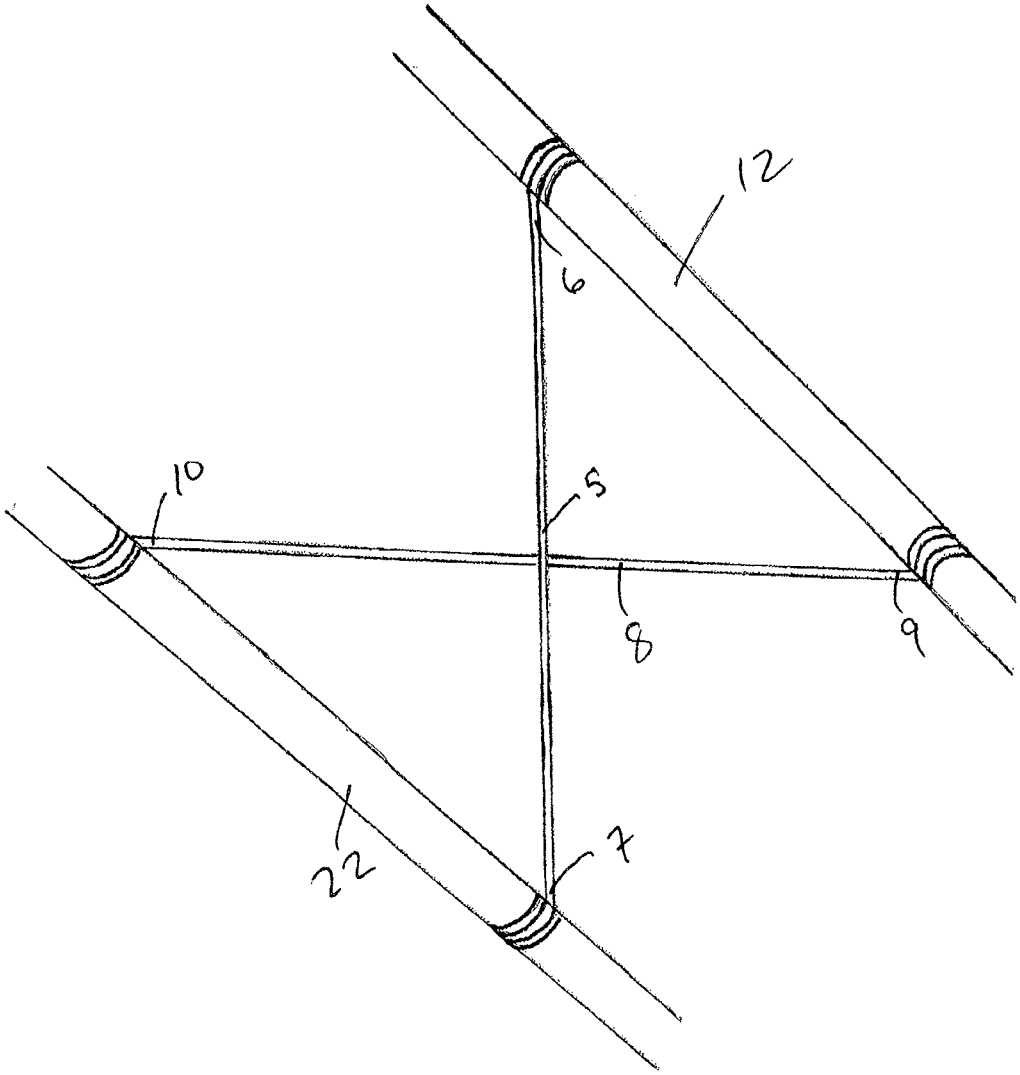
FIG. 4 illustrates a bottom to top view one embodiment of the instant invention depicting two ridge poles and two anti-spreaders.

FIG. 4 depicts another embodiment having the first anti-spreader 5 having the first anti-spreader first end 6 wrapped around first ridge pole intermediate region 12, the first anti-spreader second end 7 wrapped around the second ridge pole intermediate region 22, the second anti-spreader 8 having the second anti-spreader first end 9 wrapped around first ridge pole intermediate region 12, and the second anti-spreader second end 10 wrapped around the second ridge pole intermediate region 22.

Figure 5:
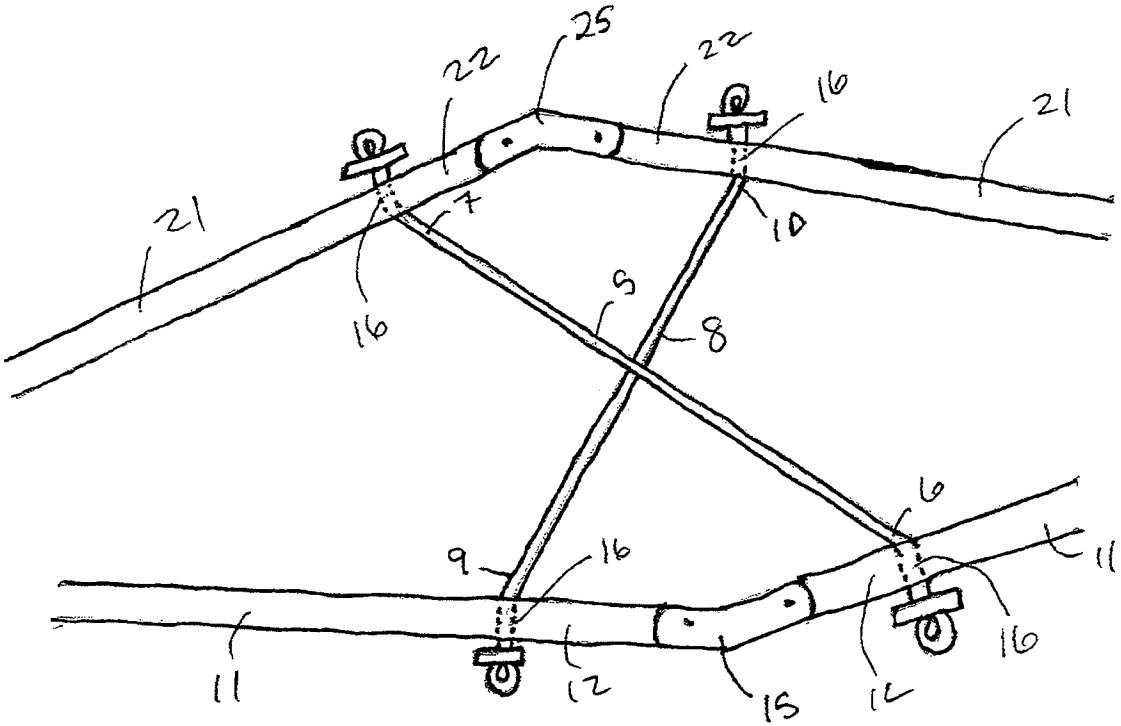
FIG. 5 illustrates a bottom to top view one embodiment of the instant invention depicting two ridge poles having junctions and two anti-spreaders.

FIG. 5 depicts another embodiment of the instant invention wherein the first ridge pole 11 has a first ridge pole intermediate junction 15 disposed in the first ridge pole intermediate portion 12 and the second ridge pole 21 has a second ridge pole intermediate junction 25 disposed in the second ridge pole intermediate portion 22. In FIG. 5, the first anti-spreader 5 comprises the first anti-spreader first end 6 attached to the first ridge pole intermediate region 12 of the first ridge pole 11 through ridge pole perforation 16. The first anti-spreader 5 has a first anti-spreader second end 7 attached to the second ridge pole intermediate region 22 of the second ridge pole 21 through ridge pole perforation 16. Also depicted is a second anti-spreader 8 having the second anti-spreader first end 9 attached to the first ridge pole intermediate region 12 of the first ridge pole 11 through ridge pole perforation 16. The second anti-spreader 8 has a second anti-spreader second end 10 attached to the second ridge pole intermediate region 22 of the second ridge pole 21 through ridge pole perforation 16.

In FIG. 5 the first ridge pole intermediate junction 15 is disposed in the first ridge pole intermediate portion 12 between two ridge pole perforations in the first ridge pole 11 and the second ridge pole intermediate junction 25 is disposed between two ridge pole perforations in the second ridge pole 21.

Clearly, there are many means of attaching lines and anti-spreaders to poles as known by those skilled in the art of line and pole attachment and such attachment means are fully contemplated within the embodiments of this invention. It is further contemplated within the scope of this invention that the base poles, in addition to the ridge poles have perforation through the poles to accommodate lines as well. It is also fully anticipated in the instant invention that the poles, both ridge poles and base poles comprise telescopic connections for lengthening and shortening in many embodiments comprising the instant invention.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. An anti-spreader hammock stand comprising a first ridge pole, a second ridge pole, a first anti-spreader, a first base pole, a second base pole, a third base pole, a fourth base pole, a first base ridge line, a second base ridge line, a third base ridge line, a fourth base ridge line, a first base ridge junction and a second base ridge junction;

said first ridge pole having a first ridge pole proximal end, a first ridge pole distal end, and a first ridge pole intermediate portion between the first ridge pole proximal end and the first ridge distal end, said second ridge pole having a second ridge pole proximal end, a second ridge pole distal end and a second ridge pole intermediate portion between the second ridge proximal end and the second ridge pole distal end;

said first base pole having a first base pole top portion and a first base pole bottom portion, said second base pole having a second base pole top portion and a second base pole bottom portion, said third base pole having a third base pole top portion and a third base pole bottom portion said forth base pole having a forth base pole top portion and a forth base pole bottom portion;

said first base ridge line having a first base ridge line upper end and a first base ridge line lower end, said second base ridge line having a second base ridge line upper end and a second base ridge line lower end, said third base ridge line having a third base ridge line upper end and a third base ridge line lower end, said fourth base ridge line having a fourth base ridge line upper end and a fourth base ridge line lower end;

said first anti-spreader having a first anti-spreader first end and a first anti-spreader second end, said first anti-spreader first end connected to said first ridge pole and said first anti-spreader second end connected to said second ridge pole;

said first base ridge junction connected to said first ridge pole proximal end, said second ridge pole proximal end, said first base pole top portion and said second base pole top portion, said second base ridge junction connected to said first ridge pole distal end, said second ridge pole distal end, said third base pole top portion and said forth base pole top portion; and said first base ridge line upper end connected to said first ridge pole intermediate portion and said first base ridge line lower end connected to said first base pole bottom portion, said second base ridge line upper end connected to said second ridge pole intermediate portion and said second base ridge line lower end connected to said second base pole bottom portion, said third base ridge line upper end connected to said first ridge pole intermediate portion and said third base ridge line lower end connected to said third base pole bottom portion, said fourth base ridge line upper end connected to said second ridge pole intermediate portion and said fourth base ridge line lower end connected to said fourth base pole bottom portion.

2. The anti-spreader hammock stand of claim 1, further comprising a second anti-spreader, said second anti-spreader having a second anti-spreader first end and a second anti-spreader second end, said anti-spreader first end connected to said first ridge pole and said anti-spreader second end connected to said second ridge pole.

3. The anti-spreader hammock stand of claim 1, wherein the first ridge pole has a first ridge pole intermediate junction disposed in the first ridge pole intermediate portion and the second ridge pole has a second ridge pole has a second ridge pole intermediate junction disposed in the second ridge pole intermediate region.

4. The anti-spreader hammock stand of claim 3, further comprising a second anti-spreader, said second anti-spreader having a second anti-spreader first end and a second anti-spreader second end, said second anti-spreader first end connected to said first ridge pole and said second anti-spreader second end connected to said second ridge pole, said first ridge pole intermediate junction disposed between where the first anti-spreader connects to the first ridge pole and the where the second anti-spreader connects to the first ridge pole and said second ridge pole intermediate junction disposed between where the first anti spreader connects to the second ridge pole and where the second anti-spreader connects to the second ridge pole.

5. The antispreader hammock stand of claim 1, wherein the ridge poles have perforations to receive antispreader ends.

6. The anti-spreader hammock stand of claim 1, further comprising a base pole line connecting the first base pole bottom portion and the second base pole bottom portion, a second base pole line connecting the bottom of the first pole bottom portion and third base pole bottom portion, a third base pole line connecting the second base pole bottom portion and the fourth base pole bottom portion and a fourth base pole line connecting the third base pole bottom portion and the fourth base pole bottom portion.

7. The anti-spreader hammock stand of claim 1, further comprising a hammock attached to the first base ridge junction and second base ridge junction.

8. The anti-spreader hammock stand of claim 1, further comprising perforations in base poles to receive base ridge lines.

9. The anti-spreader hammock stand of claim 1, wherein the ridge poles and base poles can be comprised of telescopic poles.

10. An anti-spreader hammock stand comprising a first ridge pole, a second ridge pole, a first anti-spreader, a second anti-spreader, a first base pole, a second base pole, a third base pole, a fourth base pole, a first base ridge junction and a second base ridge junction;

said first ridge pole having a first ridge pole proximal end, a first ridge pole distal end, and a first ridge pole intermediate portion between the first ridge pole proximal end and the first ridge distal end, said second ridge pole having a second ridge pole proximal end, a second ridge pole distal end, a second ridge pole intermediate portion between the second ridge proximal end and the second ridge pole distal end, a first base ridge line, a second base ridge line, a third base ridge line, and a fourth base ridge line;

said first base pole having a first base pole top portion and a first base pole bottom portion, said second base pole having a second base pole top portion and a second base pole bottom portion, said third base pole having a third base pole top portion and a third base pole bottom portion said forth base pole having a forth base pole top portion and a forth base pole bottom portion;

said first anti-spreader having a first anti-spreader first end and a first anti-spreader second end, said first anti-spreader first end connected to said first ridge pole and said first anti-spreader second end connected to said second ridge pole;

said second anti-spreader having a second anti-spreader first end and a second anti-spreader second end, said anti-spreader first end connected to said first ridge pole and said anti-spreader second end connected to said second ridge pole;

said first base ridge junction connected to said first ridge pole proximal end, said second ridge pole proximal end, said first base pole top portion and said second base pole top portion, said second base ridge junction connected to said first ridge pole distal end, said second ridge pole distal end, said third base pole top portion and said forth base pole top portion; and said first base ridge line having a first base ridge line upper end and a first base ridge line lower end, said second base ridge line having a second base ridge line upper end and a second base ridge line lower end, said third base ridge line having a third base ridge line upper end and a third base ridge line lower end, said fourth base ridge line having a fourth base ridge line upper end and a fourth base ridge line lower end, said first base ridge line upper end connected to said first ridge pole intermediate portion and said first base ridge line lower end connected to said first base pole bottom portion, said second base ridge line upper end connected to said second ridge pole intermediate portion and said second base ridge line lower end connected to said second base pole bottom portion, said third base ridge line upper end connected to said first ridge pole intermediate portion and said third base ridge line lower end connected to said third base pole bottom portion, said fourth base ridge line upper end connected to said second ridge pole intermediate portion and said fourth base ridge line lower end connected to said fourth base pole bottom portion.

* * * * *